US005302049A

United States Patent [19]

Schmanski

[11] Patent Number: 5,302,049

[45] Date of Patent: Apr. 12, 1994

[54] MOBILITY GUIDE TILE FOR VISUALLY HANDICAPPED

[75] Inventor: Donald W. Schmanski, Carson City, Nev.

[73] Assignee: Guidance Systems, Inc., Carson City, Nev.

[21] Appl. No.: 640,876

[22] Filed: Jan. 14, 1991

[51] Int. Cl.[5] ..... E01C 5/00; E01C 5/18; E01F 11/00

[52] U.S. Cl. ..... 404/42; 404/15; 404/32

[58] Field of Search ..... 404/42–45, 404/32, 34, 10, 15

[56] References Cited

U.S. PATENT DOCUMENTS 4,080,087 3/1978 Phillips ..... 404/42 X
4,092,081 5/1978 Schmanski ..... 404/10
4,515,499 5/1985 Furiate ..... 404/6
4,620,816 11/1986 Kupfer ..... 404/6
4,715,743 12/1987 Schmanski ..... 404/42 X

*Primary Examiner*—Kenneth J. Dorner
*Assistant Examiner*—Nancy Mulcare
*Attorney, Agent, or Firm*—Thorpe, North & Western

[57] ABSTRACT

A tile for positioning on walkways, crosswalks and other areas of pedestrian traffic for providing direction and warning to visually handicapped persons. The tile includes a flat plate having top and bottom surfaces and an array of raised bumps coupled and formed integrally with the top surface of the plate and projecting upward therefrom in a tactile pattern for providing tactile information. The combination of plate and raised bumps is comprised of fiber reinforced, thermosetting resin to form a rigid tile of integral construction.

6 Claims, 1 Drawing Sheet

MOBILITY GUIDE TILE FOR VISUALLY HANDICAPPED

BACKGROUND OF THE INVENTION

1. Field of Invention

The invention relates to modular tactile surfaces which are applied to roads, walkways and other areas of pedestrian traffic for providing guidance to persons who are visually handicapped. More specifically, the present invention relates to rigid tiles having circular and elongated tactile projections which alert the blind to hazardous conditions or provide travel directions.

2. Prior Art

In an earlier patent, U.S. Pat. No. 4,715,743, the present inventor disclosed an improved tactile tile which included an arrangement of projecting bumps configured either as dots or bars. These respective tiles are illustrated in FIGS. 1 and 3 of that patent. The dot tile of FIG. 1 includes a flat plate 10 comprised of a single layer of flexible plastic or rubber having a top surface 11 and a bottom surface 12. The peripheral edge 14 was chamfered from the plate thickness down to approximately 1 millimeter. The primary purpose for this chamfered configuration was to provide improved adhesion of the periphery of the tile to the road or sidewalk surface. Rubber tiles prior to this configuration would tend to lift at the tile edge, creating a safety hazard as the tile periphery would project upward. As dust, sand or water fell into this detached area, further detachment would occur, until the tile edge was sufficiently raised to trip or otherwise interfere with pedestrian movement.

The chamfered edge provided reduced tendency to curl up because of the reduced thickness. A surrounding gasket formed between tiles by the adhesive applied underneath the tile further contributed to retention of the chamfered edge. As the tile and attached mastic were pressed against the sidewalk or other support surface, the mastic would flow and partially escape through the peripheral crack between adjacent tiles. A sufficient quantity of mastic could seep through this crack, forming a bead which extended over the chamfered edge of the tile. This operated to not only lock the tile in place, but also blocked water and dirt from creeping under the tile to thereby weaken the bonded connection.

This flexible tile configuration was adopted because it offered two features considered important to the visually handicapped. The first feature was a resilient aspect provided by the rubber composition. This resilience appeared to enhance the sensitivity of the foot for tactile detection. As was stated in column 6, lines 49 to 53 of the referenced —743 patent "synthetic rubber compositions are ideal material for the subject tiles. Such compositions include the resilience and high coefficient of friction which enhance the textural, sound and other physical properties required for a tactile surface for the blind."

The second aspect is also mentioned in the above quote, relating to sound response of the tile. Prior art compositions of flexible polymers and rubber materials were specifically chosen because of the distinctive sound response made by walking on the rubber tiles. The contrast of sound produced from a pavement surface and the distinctive sound of the rubber tile was readily recognizable to the blind. This distinctive sound enabled the visually handicapped to recognize that they had just stepped onto a tactile tile, alerting this person to consider instructions provided by the tiles.

The use of flexible polymers and rubber compositions for tactile tiles has become an established practice in the industry. Initial use of rubber compositions arose with the early development of special design features for walking mats for stairs. For example, U.S. Pat. No. 348,782 issued in 1886 and 873,420 issued in 1907 disclosed the value of such compositions for stair treads. This material was applied in the highway environment for directing traffic as taught in U.S. Pat. No. 2,018,260 issued in 1931. Other efforts to shift away from the rubber compositions for walking surfaces have not met with any level of success. For example, U.S. Pat. No. 2,421,171 teaches the use of a thin steel plate with raised bumps for a stair tread, but has not received commercial acceptance.

With the emergence of tactile tile as a tool for assisting visually handicapped persons, the same tradition of rubber compositions was carried forward. U.S. Pat. No. 4,080,087 issued in 1978 disclosed a foot tile that was designed to give direction to a blind person. These tiles were recommended to be of polymers used in the highway industry prior to 1977, which were of flexible, resilient type materials. In the early 1980's the Japanese introduced tactile tiles in Japan and adopted the standard rubber-like composition which has become characteristic in the industry. In 1985, this same synthetic rubber became the specified composition in the federal specification for Tactile Mobility Aids for the Blind, specification number TT101. The use of synthetic rubber and similar flexible polymers has been the standard for tactile tiles up to the present time.

This is not to say that other polymers have not been present within the public safety arena. In 1978, the named inventor herein introduced the first fiberglass delineator for traffic control under U.S. Pat. No. 4,092,081. This was a direct contrast with pre-1978 polymers because this fiber reinforced, thermosetting polymer composite was rigid as opposed to flexible. In fact, short lengths of less than one foot, were almost as stiff as steel. Although it was considered suitable as a guide strip for traversing an intersection (U.S. Pat. No. 4,715,743), there was no recognition of utility in the field of tactile tiles. Its function as a guide strip was to provide a straight track for contacting by a cane or cue of the visually handicapped pedestrian. It was not designed for foot traffic. The federal specification for this guide strip is identified as TT1004.

Where departures from the use of synthetic rubber or flexible polymers for textile tiles have been suggested, these have not included application of rigid composites of thermosetting plastics. For example, U.S. Pat. No. 4,620,816 issued in 1986 discloses the concept of tactile simulation over an entire walking surface. The recommended materials included carpet of differing heights or pebbles of differing size imbedded in concrete. It is clear that the feature of sound recognition was not a criteria in selection of tactile compositions under the teachings of this patent.

The commercial reality of the tactile tile market is evidenced by the preceding historical review. The same flexible, rubber-like materials which have dominated the stair tread/tactile tile market for over one hundred years remain the primary composition in use today. Even more interesting is the fact that despite hundreds of new compositions that have developed over the last decade, none have made a significant inroad as a replacement composition.

It should not be presumed that the reason for such faithful allegiance to flexible polymers is a total absence of dissatisfaction with the product. To the contrary, the use of flexible polymers continues to develop challenges with respect to tile placement and retention. The flexibility of such tiles frequently results in detachment around the periphery or at the corners. Flexible tiles also have a tendency to adversely respond to changes in temperature. In short, there continues to be problems with flexible tiles; however, a suitable alternative which provide correct sound and tactile response has not been identified.

OBJECTS AND SUMMARY OF THE INVENTION

It is an object of the present invention to provide a rigid, durable material as an appropriate composition for a tactile tile. It is further object of this invention to provide a tactile tile having distinctive sound response, yet which offers the advantages of a rigid tile as compared to a tile constructed of flexible polymer.

Yet another object of the present invention is to provide a tactile tile which has enhanced durability and weatherability.

These and other objects are realized in a tile for positioning on walkways, crosswalks and other areas of pedestrian traffic for providing direction and warning to visually handicapped persons wherein the tile is constructed of fiber reinforced plastics including thermosetting matrix materials. Such a tile includes a flat plate having a top and bottom surface, with raised bumps coupled and formed integrally with the top surface of the plate and projecting upward therefrom and being configured as truncated structure having a larger base attached at the top surface of the plate and tapering to a narrower top which includes a substantially flat, contacting surface adapted to withstand contact with footwear without significant wear. Both the plate and raised bumps are fabricated with fiber reinforced thermoplastics to form a rigid structure which provides distinctive sound response to foot traffic.

Other objects and features of the present invention will be apparent to those skilled in the art, in view of the following detailed description, taken in combination with the accompanying drawings.

DETAILED DESCRIPTION OF THE INVENTION

Figure 1:
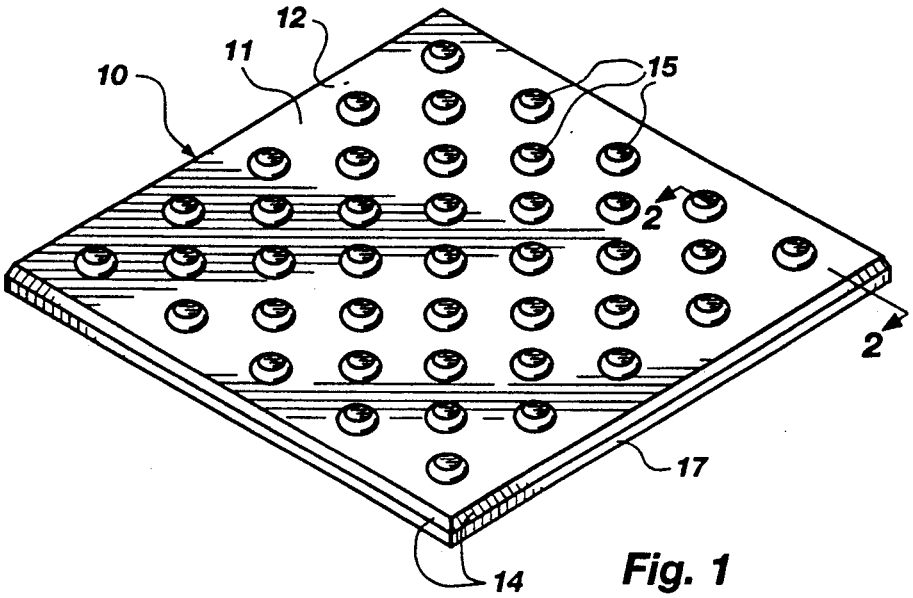
FIG. 1 shows a perspective view of a tile formed in accordance with the present invention.

FIG. 1 shows a tile 10 of square configuration with an arrangement of bumps forming a tactile pattern in accordance with federal specifications for assisting visually handicapped persons. This tile includes a flat plate having a top 11 and bottom 12 surface defining a plate thickness 13 of less than 4 millimeters. The preferred thickness is considered to approximately 1.8–2.2 millimeters. The peripheral edge may be chamfered as illustrated as illustrated at item 14 of FIG. 1, or may be blocked in square configuration as shown at item 17, except that the squared configuration would continue to the top surface 11 of the tile.

This tile 10 with its array of tactile bumps 15 provides the same configuration as was supplied by earlier synthetic rubber tiles but does not embody the flexible construction characteristic of the prior art. Despite the fact that prior studies indicated the need for flexible polymers to generate sound response detectible to visually handicapped persons, the present inventor has discovered the surprising utility of fiberglass and other reinforced composite materials which are rigid. It has been determined that a conventional, thermosetting resin, composition by weight of 15 to 50% by weight glass provides acceptable sound response which enables detection by the visually handicapped of the unique tactile surface. This is true despite the comparable structural similarities of fiber reinforced thermosetting resins with concrete and other composites which have not been acceptable as tactile surfaces.

Conventional fabrication techniques may be applied with respect to formation of such tactile tiles from the fiber reinforced plastics. For example, glass mat may be laid within the desired mold, followed by application of uncured resin which is then subjected to heat or other energy for polymerization and curing. Similarly, sheet molding techniques can be applied to form the desired tile, as can bulk molding procedures. Filler material may likewise be introduced to reduce the amount of resin needed in the composite.

The primary function of plate 10 is to provide a convenient structure for positioning the array of bumps 15 at a location and height appropriate for providing notice to the visually handicapped of a hazardous condition or a proper direction for movement. The raised bumps 15 are coupled to the top surface 11 of the plate and project upward therefrom to a maximum height above the top surface of less than 6 millimeters. It has been determined that optimum balance of safety and sound/textural sensitivity is realized when the array of bumps have a height less than 6 millimeters and are appropriately spaced as described hereafter.

Although the configuration of the bumps may vary, certain height limitations exist in order to maintain desired balance between safety, tactile sensitivity and uniformity. For example, the total height 16 of the plate and bump above the road surface is preferably 7 to 8 millimeters allowing approximately 1 millimeter of thickness for the adhesive 17. The thickness 18 of the adhesive layer 17 is discussed hereafter.

Figure 3:
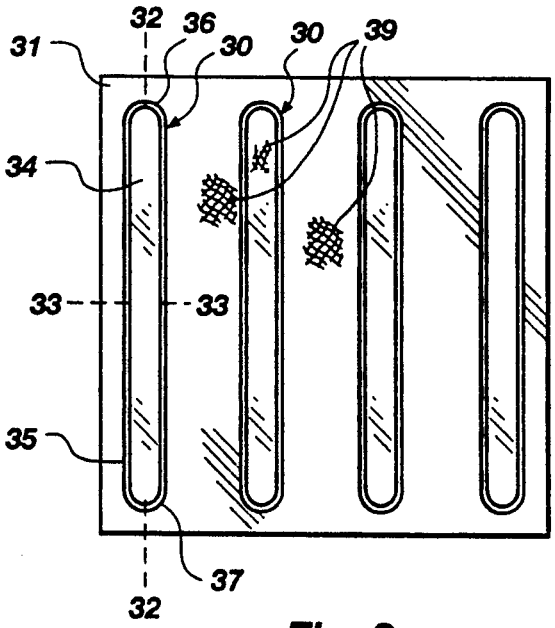
FIG. 3 is a graphic portrayal of an additional embodiment of the subject tile, utilizing elongated or bar structure as opposed to the circular or dot configuration of FIG. 1.

The preferred height 19 of the bump 15 above the top surface 11 is approximately 5 millimeters, with the plate thickness 13 being 1.8 to 2.0 millimeters. The bumps have a minimum width 20 of approximately 20 millimeters with a preferred width of 23 millimeters at its base. It should be noted that longer dimensions exist where the bumps are elongated as shown in FIG. 3. No minimum or maximum lengths are provided with respect to the elongated distance because the individual stepping on such a bump need only sense the thickness along one direction to identify the raised structure as part of a tactile surface.

Figure 2:
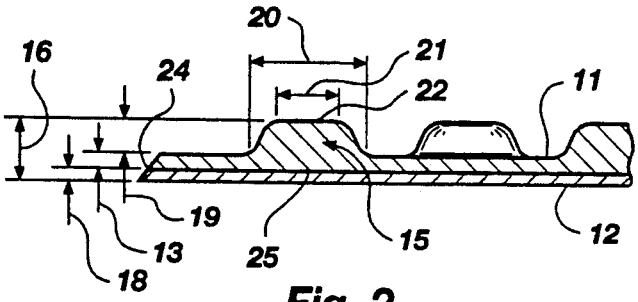
FIG. 2 is a cross section taken along the lines of 2—2 of FIG. 1.

In each case, the bumps are configured as truncated structure having a larger base attached at the top surface 11 of the plate and tapering to a narrower top 21 which includes a substantially flat surface 22. This structure may be spherical in lateral configuration as shown in FIG. 2 having the indicated rounded lateral structure, or it may conical. Other truncated, tapering structures will be apparent to those skilled in the art.

The arrangement of bumps shown in FIG. 1 is referred to herein as a dot tile because the bumps are non-elongated in any particular direction. Although the dot tile of FIG. 1 shows circular bumps, a square bump would likewise be feasible in dot tile configuration.

FIG. 3, however, illustrates the use of elongated bumps 30 which are positioned on a plate 31 similar in construction and design to the tile plate 10 of FIG. 10. Whereas the dot tile of FIG. 1 includes 41 separate bumps, the elongated bar tile of FIG. 3 includes only 4 bumps. The utility of a different configuration for the bar tile bump 30 arises from the directional information which can be given from the elongated structure.

When viewed along its longitudinal axis 32, the cross section of the elongated bump 30 has an appearance substantially the same as the cross section of the dot shown in detail at the left side of FIG. 2. A view along the shorter axis 33 would have a comparable appearance, except that the bump would be elongated with flat surface 22 (FIG. 2) being extended the full length of a flat surface 34 configured at the top of the elongated bump 30. Accordingly, the elongated bump has a configuration similar to a half section bar cut approximately along the longitudinal axis 32 through the diameter of the bar to form the larger base 35 of the bump. The top of the bar 30 is truncated to form the narrower top section 34 as a flat surface substantially parallel with the plate. Each opposing end 36 and 37 of the bar is rounded to resemble a quarter sphere similar to that shown in FIG. 2 for the bump in cross section.

Because of the increased surface area of the bump of a bar tile, a rough texture 39 is impressed in the top surface 34 to prevent slipping when the bar tile is wet. It has been found that the particular configuration of bar tiles as disclosed herein have a preferred texture wherein the grooves, channels or ridges are formed to a depth or height of approximately 0.25 millimeters at the surface. The same textured surface 39 should be placed between bar bumps to avoid slipping of the end of a cane.

With respect to the bar tile shown in FIG. 3, the total dimension of the plate 31 is 300 millimeters square. Four bars of the tile extend to lengths of approximately 285 millimeters at the base. Each of the bars is displaced approximately 75 millimeters on center from adjacent bars.

These tiles are positioned on the paving surface in accordance with the instruction set forth in U.S. Pat. No. 4,715,473, which instructions are incorporated herein by reference. This attachment is accomplished by use of adhesives which are flowable to form a uniform adhesive layer 17 at the bottom surface 12 of the tile. Typically, this adhesive thickness will be at least 0.5 millimeters. Adhesives should have a force to compression of 50 to 200 pounds. Adhesive needs to be capable of retaining its tack and adhesive qualities for −50 degrees fahrenheit to +140 degrees fahrenheit and should preferably have a elongation of approximately 450% at 77 degrees fahrenheit. If the chamfered construction as illustrated in FIGS. 1 and 2 is utilized, it is preferable to form a bead to seal the junctures of respective tiles in accordance with the teachings of U.S. Pat. No. 4,715,743. The appropriate combinations of configuration of these tiles is part of a system for guiding a visually handicapped person is also set forth in the 4,715,743 patent.

The present invention utilizing fiber reinforced, thermosetting resin composite offers several advantages over the prior synthetic rubber composition disclosed in the prior art. Specifically, the rigid structure of a thermosetting composite has increased durability because of its rigid construction, and has improved weatherability by virtue of its resistance to ultraviolet radiation and other weathering aspects. Whereas the prior art flexible materials would tend to curl at the edges and detach from the paving surface, the rigid, composite structure of the present invention remains flat at its edges and avoids detachment. This provides a more durable walking surface with less cost of maintenance, and less risk of pedestrian stumbling.

Despite prior art expectation to the contrary, the rigid, fiber reinforced plastic construction provides a sufficiently distinctive sound que to a visually handicapped pedestrian to enable them to recognize the occurrence of a tactile tile providing instruction and directional information. The ability to configure such composite materials in any shape by conventional molding techniques enables duplication of the prior federal specifications applied with respect to flexible polymers. The general specifications can therefore be maintained with respect to established standards for tactile tiles within this industry.

I claim:

1. A tile for positioning on walkways, crosswalks and other areas, of pedestrian traffic for providing direction and warning to visually handicapped persons, said tile comprising:

(1.1) a flat plate having a top and bottom surface; and (1.2) raised bumps coupled and formed integrally with the top surface of the plate and projecting upward therefrom in a tactile pattern for providing tactile information to a visually handicapped person, and being configured as truncated structure having a larger base attached at the top surface of the plate and tapering to a narrower top which includes a substantially flat, contacting surface adapted to withstand repeated contact with footwear;

(1.3) said flat plate and raised bumps being comprised of fiber reinforced, thermosetting resin to form a rigid tile of integral construction.

2. A device as defined in claim 1, further including a uniform adhesive layer applied at the bottom surface for attaching the tile to the area of pedestrian traffic.

3. A device as defined in claim 1, wherein the bump is approximately configured as a truncated hemisphere having a flat top surface substantially parallel with the flat plate.

4. A device as defined in claim 1, wherein the flat surface of the bump includes a rough texture to provide traction against slipping.

5. A device as defined in claim 1, wherein the bump is approximately configured as a half-section bar cut approximately along the longitudinal axis to form the larger base of the bump, the top of the bar being truncated to form the narrower top as a flat surface substantially parallel with the plate, each opposing end of the bar being rounded to resemble a quarter-sphere, the length of the bar extending nearly the full length of the plate.

6. A device as defined in claim 1, wherein the flat plate includes a chamfered edge around the periphery of the plate extending down from the top surface to a narrower thickness with respect to the bottom surface.

* * * * *